United States Patent [19]

Meyers

[11] Patent Number: 4,670,658

[45] Date of Patent: Jun. 2, 1987

[54] PROTECTIVE SHEET

[75] Inventor: Phillip H. Meyers, New Orleans, La.

[73] Assignee: E-Z-EM, Inc., Westbury, N.Y.

[21] Appl. No.: 751,519

[22] Filed: Jul. 2, 1985

[51] Int. Cl.[4] ..... G21F 3/02

[52] U.S. Cl. ..... 250/519.1; 250/519.1; 250/515.1; 428/283; 428/913

[58] Field of Search ..... 428/240, 246, 247, 283, 428/284, 286, 323, 913; 250/505.1, 515.1, 519.1

[56] References Cited

U.S. PATENT DOCUMENTS 4,041,872 8/1977 McCorn et al. ..... 250/515.1

4,286,170 8/1981 Moti ..... 250/515.1

*Primary Examiner*—James J. Bell

*Attorney, Agent, or Firm*—McAulay, Fields, Fisher, Goldstein & Nissen

[57] ABSTRACT

A multi-ply sheet having a center ply support matrix in which the radio opaque compound barium sulfate is distributed as a powder and is supported by the matrix. The barium sulfate is present in an amount sufficient to block scatter radiation produced by the medical radiology procedures. A base ply of a thin liquid impervious polyethylene material is fastened to one side of the support matrix ply. A third ply is composed of a typical absorptive surgical drape material and is fastened to the other side of the support matrix ply.

15 Claims, 4 Drawing Figures

PROTECTIVE SHEET

BACKGROUND OF THE INVENTION

This invention relates to a sanitary protective sheet useful for reducing exposure to scatter radiation generated during radiological operating procedures.

Scatter radiation occurs when relatively high energy photons from an X-ray beam interact with the atoms against which they impinge to generate secondary radiation. This secondary radiation tends to be lower frequency radiation than the primary radiation. That is, the secondary radiation has a frequency range that would be produced by voltage settings on the X-ray machine lower than the setting for the primary radiation. Because the secondary radiation is not beamed or focused it tends to be directed in all directions and thus is called scatter radiation.

Radiological procedures include both fluoroscopic and radiographic procedures. Although most radiographic procedures are not invasive operations, a large number of the fluoroscopic procedures presently performed are invasive operations. During these invasive procedures it is particularly important to maintain a sterile field at all times.

Fluoroscopy is a procedure which renders visible the shadow of X-rays to permit observation of the internal organs of the human body. There are many procedures which are preformed under a fluoroscope so that the radiologist can monitor and control the procedure. Fluoroscopy, as compared to standard X-ray examination, uses a lower voltage X-ray. Examples of procedures requiring fluoroscopic monitoring and control are: angiographic procedures; percutaneous nephrostomy; lung biopsy; endoscopic cholangiograms; pancreaticography; and percutaneous transhepatic cholangiogram. During the majority of these, an X-ray beam is focused on the patient at a point distanced from the radiologist or other doctor performing the procedure. Although the doctor is not exposed to the primary radiation, he or she is exposed to scatter radiation. The arm and hand area of the doctor are most commonly exposed to such scatter radiation.

These fluoroscopic procedures are invasive and generally require the use and manipulation of small instruments. It is necessary to perform these procedures in a sterile environment. The procedures require manual dexterity on the part of the radiologist.

It is well documented that exposure to X-rays is injurious. It is further known that X-ray exposure is cumulative. Although the amount of X-ray exposure that a patient receives during a single fluoroscopic procedure may not be harmful, a radiologist who performs a great number of such procedures, is constantly exposed to X-rays and hence a large cumulative exposure. It has long been recognized that radiologists, and other workers with X-rays, must protect themselves as much as possible from X-rays. Any reduction in cumulative exposure is desirable.

It is known in the art that lead impregnated rubber gloves and aprons will protect the radiologist by absorbing some of the scatter radiation generated during a fluoroscopic procedure. These gloves however, are too clumsy to wear while performing delicate operative procedures. In addition, both the gloves and aprons are relatively expensive and not easily sterilized.

Accordingly, it is an object of this invention to provide a protective sheet which can be used during a radiological procedure to protect the radiologist or other doctor from scatter radiation.

It is important that the protective sheet not interfere with the doctor's ability to perform a delicate interventional procedure. Thus it is another purpose of this invention to provide a simple device that does not interfere with any of the operating procedures.

It is another purpose of this invention to achieve the above results with a protective sheet which permits maintaining sterilization.

It is a related purpose to provide a sheet which is disposable so that a sterile environment can be maintained during each operation.

It is a related object of this invention to provide a setting which permits the doctor to move in a sterile environment.

It is a further purpose of this invention to provide the objects at a cost which will encourage use of the protective product and with a device that is simple and easy to use so that it will readily and regularly be used.

BRIEF DESCRIPTION

In brief one embodiment of the invention employs a multi-ply sheet in which a center ply support matrix is a gauze sheet in which a radio opaque compound and in particular barium sulfate powder, is distributed and is supported by the matrix. The barium sulfate is present in an amount suffient to block a substantial amount of the scatter radiation produced by the standard medical radiology machines which may have voltage settings up to 120 kilovolts (KV). In this embodiment, a base ply of a thin liquid impervious polyethylene material is fastened to one side of the support matrix ply. The third ply is composed of a typical surgical drape material which acts to absorb liquid such or blood. It is fastened to the other side of the support matrix ply.

This multi-ply protective sheet is relatively light weight and avoids being a bulky type of device. Yet it effectively absorbs the scatter radiation. Further, since it is relatively inexpensive to produce it is disposable and thus avoids the problem of cross contamination that would occur in the use of the same protective sheet in successive operations. Unlike protective gloves, the sheet need not be worn by the radiologist and thus does not adversely affect his or her manual dexterity.

THE FIGURES

DESCRIPTION OF THE PERFERRED EMBODIMENTS

Figure 1:
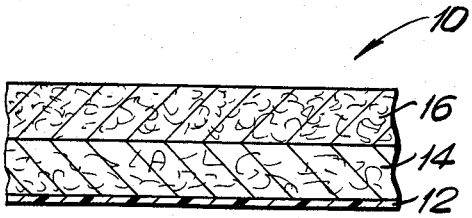
FIG. 1 is a cross sectional view through a segment of a first embodiment illustrating a three ply sheet in which the center sheet 14 contains the radio-opaque material.

In FIG. 1 the sheet 10 includes a radio-opaque ply 14 formed of a support matrix and a radio-opaque compound supported by the matrix. A thin, impermeable to liquid polyethylene base ply 12 is attached to and positioned below the radio-opaque ply 14. An absorbant surgical drape ply 16 is attached to and possitioned above radio-opaque ply 14. Plies 12 and 16 reduce any possibility of leakage of the radio-opaque compound into the surgical field. Additionally, ply 16 acts as an absorbant layer to sponge-up blood and other fluids.

The radio-opaque ply 14 is a gauze sheet which carries barium sulfate powder. The gauze sheet can be impregnated with the barium sulfate by soaking the gauze sheet in barium sulfate suspension and then evaporating the water thus providing an even distribution of the barium sulfate in the ply 14. Alternatively it might be possible to apply the barium sulfate dry to the gauze.

The amount of powdered barium sulfate in the gauze ply can be anywhere from 350 to 730 grams per square foot. This will block anywhere from fifty percent (50%) to one hundred percent (100%) of the incident radiation up to the X-ray frequency generated at a 120 KV setting on the radiology machine.

The plies 14 and 16 can be anywhere from one-quarter to one-half inch thick each and the ply 12 can be in the order of two to four mils (0.002 to 0.004 inches).

The following test was conducted on the effectiveness of the radio-opaque ply. A fluoroscopic exposure was made of an upper abdomen phantom using a ten inch field, at an X-ray machine setting of ninety KV and three milli-amperes. A pocket radiation dosimeter was placed in the left inguinal region (groin) supported by three-fourths of an inch (0.75 in) thick qauze and held in place by tape. The phantom was then fluoroscoped for five minutes. The radiation dose registered on the pocket dosimeter was eleven millirads. The procedure was repeated replacing the gauze with a three and one-half inch by three inch barium sulfate soaked sheet containing approximately fifty-five (55) grams of barium sulfate thus proving a sheet having a density of about 755 grams per square foot. The sheet measured approximately 0.75 inch in thickness. The phantom was again fluoroscoped for five minutes. The dose registered on the pocket dosimeter was less than one millirad, a reduction of greater than ten to one.

Because of the cumulative effect of radiation, any reduction in radiation, even by a small amount, is a benefit to the individual exposed and thus is desirable. Accordingly, this reduction to one-tenth of the exposure that otherwise would occur reduces the risk to all operating personnel.

It is contemplated that one useful size of this protective sheet will be in the range of one square foot to two square feet. Sheets of that size can be placed under a doctor's hands during an operative procedure. Such sheets might also be placed adjacent to each other in a pattern with their edges overlapped to define an area in which radiation is not blocked and to provide a blockage of radiation outside of that area.

In the case of sheets of this size, the various plys 12, 14, 16 could be held together along their edges by, for example, surgical sterile adhesive tape or by thermal bonding or even by stitching. Where larger sheets may be employed, it might be desirable to include strips of double faced adhesive between the plys to facilitate the handling of the sheet.

Figure 2:
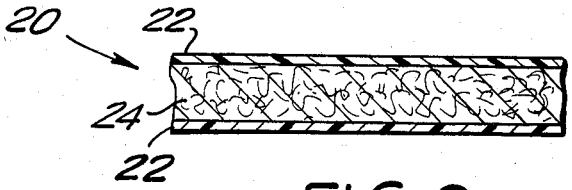
FIG. 2 is an illustration of a second embodiment of this invention involving a three ply sheet in which the center ply 24 has the radio-opaque material.

In the FIG. 2 embodiment, the sheet 20 is a three ply sheet having a center ply 24 that is substantially the same as is the radio-opaque ply 14 of the sheet 10 shown in FIG. 1. However, in this FIG. 2 embodiment, the radio-opaque ply 24 is sandwiched between two liquid impermeable polyethylene plies 22, each of which plies are substantially similiar to the ply 12 in the FIG. 1 embodiment. This FIG. 2 embodiment might be used in circumstances where the liquid absorption characteristic is not required. For example, the FIG. 2 embodiment might be used as a partition around a patient to provide protection for personnel required in the operating room from scatter radiation.

Figure 3:
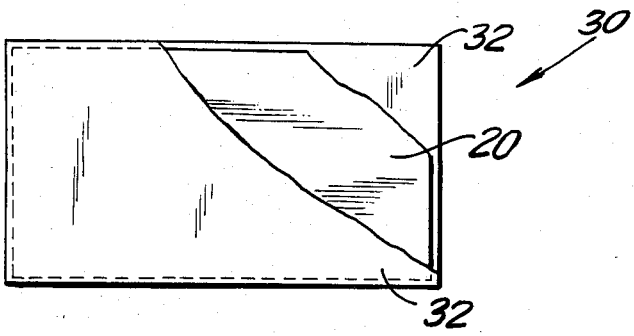
FIG. 3 illustrates a third embodiment of this invention in which the three ply sheet of FIG. 2 is contained within an envelope of absorptive surgical drape material.

However the sheet 20 can be adapted to be used in place of an actual surgical drape by slipping the sheet 20 into an envelope formed of two sheets 32 of normal surgical drape material as shown in FIG. 3. The result is a sheet 30 that is composed of five plies and which provides the liquid absorbant feature.

Figure 4:
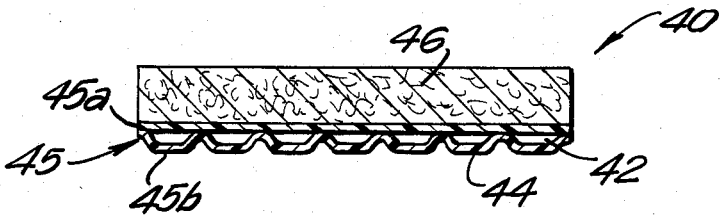
FIG. 4 illustrates a forth embodiment of this invention in which the radio-opaque material is contained within the bubble compartments of a bubble sheet of material that in turn is attached to a ply of surgical drape material.

FIG. 4 shows a forth embodiment of a sheet 40 in which powered barium sulfate 42 is carried in plastic pockets 44 of bubble packet type material. A sheet of this barium sulfate filled bubble pack material 45 is attached to a ply of surgical drape material 46 similar to the ply 16 in the FIG. 1 embodiment. In the FIG. 4 embodiment as shown, the bubble pack sheet 45 is one in which a flat ply **45*a* forms the upper surface of the pockets 44 and a formed sheet 45*b* is attached to the flat sheet 45*a* to define individual pockets 44**.

Certain applications of the sheets 10, 20, 30, 40 of this invention may require much larger sheet material than the one to two square foot material mentioned above. Large protective sheets can be laid over a patient or under a patient or both during an operating procedure. In such a case, the large sheet will require an opening therethrough so that the primary beam of x-ray will not be blocked.

Although the above description emphasizes the value of using these sheets to block secondary radiation from impinging on operating personnel, it should be recognized these sheets can be used to protect genitalia, or other body parts, of patients during radiographic procedures.

It should be recognized that the use of large size sheets of this invention over and/or below a patient during a fluoroscopic surgical procedure serves to prevent the scatter radiation from passing through the sheets and thus tends to protect all personnel in the operating room.

In many fluorscopic procedures, such as angiographic procedures, a catheter is manipulated and introduced through the femoral artery. The tip of the catheter is monitered under fluoroscopic control. If a protective sheet made in accordance with the present invention is used in the inguinal area, under or over the operator's hands, which is the region where the catheter is introduced, a decreased radiation dosage to the operator's hands by a factor of ten would result.

Because of the relatively low cost of the protective sheets of this invention, they are disposable and thus need not be used except for a single operation. Thus, sterility in the operating zone is enhanced and cross contamination is avoided. One advantage of maintaining sterility in the operating zone is that a doctor's movements are less inhibited in that his or her contact with the sterilized protective sheet of this invention does not destroy the sterilization procedures.

What is claimed:

1. A protective sheet useful for radiological procedures, comprising: a support matrix and a radio-opaque portion of barium sulfate supported by said matrix, said radio-opaque portion being present in an amount sufficient to block a substantial amount of the scatter radiation.

2. The sheet of claim 1 wherein said support portion is gauze and wherein said barium sulfate is supported in said gauze by soaking said gauze in a barium sulfate suspension and then evaporating the water therefrom.

3. The sheet of claim 1 further comprising: a base and a cover, said base being attached to and positioned on one side of said support matrix and said cover being attached to and positioned on the other side of said support matrix.

4. The sheet of claim 2 further comprising: a base and a cover, said base being attached to and positioned on one side of said support matrix and said cover being attached to and positioned on the other side of said support matrix.

5. The sheet of claim 3 wherein said base is a thin impermeable ply.

6. The sheet of claim 4 wherein said base is a thin impermeable ply.

7. The sheet of claim 3 wherein said cover is a surgical drape.

8. The sheet of claim 4 wherein said cover is a surgical drape.

9. The sheet of claim 1 wherein between 350 to 730 grams of barium sulfate powder is evenly distributed in each square foot of said support matrix.

10. The sheet of claim 3 wherein between 350 to 730 grams of barium sulfate powder is evenly distributed in each square foot of said support matrix.

11. The sheet of claim 3 wherein said sheet is at least two square feet in area.

12. The sheet of claim 3 wherein said sheet is between one-half to one inch thick.

13. A protective laminate for reducing exposure to scatter radiation generated during radiological procedures, the laminate comprising: a thin impermeable base ply, a radio-opaque ply attached to and positioned on said base ply, said radio-opaque ply including a support matrix and a radio-opaque compound supported by said matrix, said radio-opaque compound being present in an amount sufficient to block a substantial amount of the scatter radiation, and an upper ply of absorbent material attached to and positioned on said radio-opaque ply.

14. The laminate of claim 13 wherein said radio-opaque ply is impregnated with barium sulfate powder.

15. The laminate of claim 14 wherein between 350 to 730 grams of said barium sulfate powder is distributed in each square foot of said support matrix.

* * * * *